US009244396B1

(12) United States Patent
Kinouchi et al.

(10) Patent No.: US 9,244,396 B1
(45) Date of Patent: Jan. 26, 2016

(54) IMAGE FORMING APPARATUS AND CONVEYANCE SPEED CONTROL METHOD OF RECORDING MEDIUM IN IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Satoshi Kinouchi, Tokyo-to (JP); Takaho Watanabe, Mishima (JP); Ryota Saeki, Mishima (JP); Tokihiko Ise, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/331,278

(22) Filed: Jul. 15, 2014

(51) Int. Cl.
*G03G 15/20* (2006.01)

(52) U.S. Cl.
CPC ..... *G03G 15/2028* (2013.01)

(58) Field of Classification Search
CPC ..... G03G 15/2085; G03G 15/5029; G03G 15/2028
See application file for complete search history.

(56) References Cited

U.S. PATENT DOCUMENTS

| | | | | |
|---|---|---|---|---|
| 2003/0035671 | A1* | 2/2003 | Estabrooks | 399/385 |
| 2006/0222386 | A1* | 10/2006 | Koshida et al. | 399/44 |
| 2009/0310980 | A1* | 12/2009 | Tashiro et al. | 399/16 |
| 2010/0129122 | A1* | 5/2010 | Ciaschi | 399/329 |
| 2011/0097093 | A1* | 4/2011 | Birumachi | 399/21 |
| 2014/0240724 | A1 | 8/2014 | Kinouchi et al. | |

* cited by examiner

*Primary Examiner* — Gregory H Curran

(74) *Attorney, Agent, or Firm* — Amin, Turocy & Watson, LLP

(57) ABSTRACT

In accordance with one embodiment, an image forming apparatus comprises a transfer device configured to transfer an image onto a conveyed recording medium (sheet); a fixer configured to heat, press and convey the sheet to fix the transferred image on the sheet; a sensor configured to detect the bending amount of the sheet between the transfer device and the fixer; and a control section configured to control at least one of the transfer device and the fixer so that the recording medium between the transfer device and the fixer is conveyed in a bent state and the bending amount of the sheet is reduced if the bending amount of the sheet exceeds a preset one according to the detection result of the sensor.

19 Claims, 7 Drawing Sheets

IMAGE FORMING APPARATUS AND CONVEYANCE SPEED CONTROL METHOD OF RECORDING MEDIUM IN IMAGE FORMING APPARATUS

FIELD

Embodiments described herein relate to an image forming apparatus which applies heat and pressure to the toner by passing a recording medium (sheet) to which the toner is adhered through a fixer to fix the toner on the recording medium and a conveyance speed control method of the recording medium in the image forming apparatus.

BACKGROUND

Conventionally, in an electrophotographic image forming apparatus, a sheet on which toner is adhered is conveyed to a fixer to fix the toner on the sheet by applying heat and pressure to the sheet. The fixer comprises a heat roller and a press roller between which a nip part exists, when the front end of a sheet enters the nip part, the sheet receives an impact, which sometimes causes a fluctuation in conveyance speed of the sheet. The higher the pressure of the nip part is, the more possible the fluctuation in conveyance speed occurs.

The fluctuation in the conveyance speed is transferred to a transfer section in front of the fixer as vibration via the sheet, the toner image on the sheet is disordered due to the vibration; moreover, due to the vibration, the fluctuation in the rotation speed of a photoconductor occurs and sometimes a latent image may be disordered. Consequentially, the quality of the image on the sheet is deteriorated, for example, the image on the sheet is blurred or a white or black streak appears in the image on the sheet.

To prevent the deterioration in the quality of an image, an exemplary method is known according to which a sheet is bent when conveyed from a transfer section to the nip part of a fixer so as to prevent the transmission of the fluctuation in the conveyance speed of the sheet to the transfer section or a photoconductor.

However, as the conveyance speed of the sheet passing through the fixer is decreased or increased to a fixed value, if the hardness of a sheet is changed according to the basis weight of the sheet, a different environment and the like, the bending amount of the sheet will not be a fixed value. For example, there is a problem that an image blur and the like is generated, or the sheet is bent than expected such that the image on the sheet is rubbed by the conveyance section and therefore the deterioration in the quality of the image is generated when a bending amount cannot be obtained at which the vibration won't be transferred.

DETAILED DESCRIPTION

Figure 1:
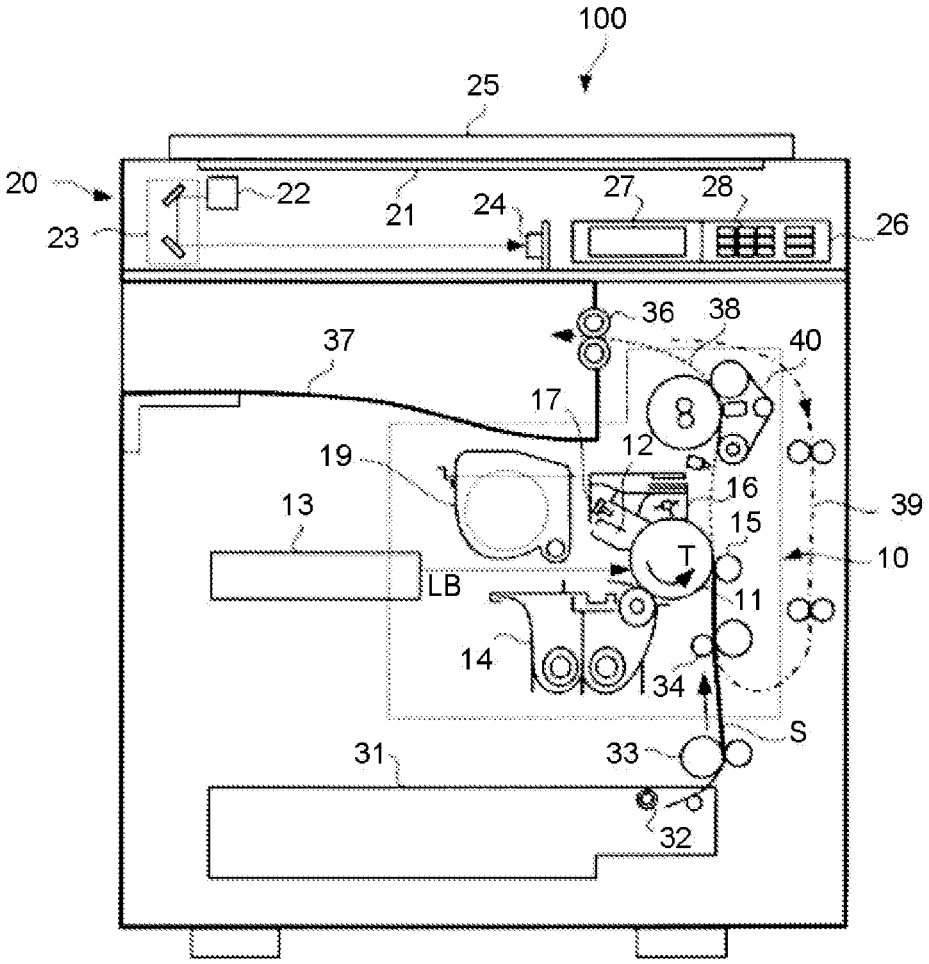
FIG. 1 is a diagram illustrating the constitution of an image forming apparatus according to an embodiment.

In accordance with one embodiment, an image forming apparatus comprises a transfer device configured to transfer an image onto a conveyed recording medium; a fixer configured to heat, press and convey the recording medium to fix the transferred image on the recording medium; a sensor configured to detect the bending amount of the recording medium between the transfer device and the fixer; and a control section configured to control at least one of the transfer device and the fixer so that the recording medium between the transfer device and the fixer is conveyed in a bent state and the bending amount of the recording medium is reduced if the bending amount of the recording medium exceeds a preset one according to the detection result of the sensor.

The image forming apparatus according to embodiments described herein is described in detail below with reference to the accompanying drawings, in each of which the same components are denoted with the same reference numerals.

Embodiment 1

FIG. 1 is a diagram illustrating the constitution of an image forming apparatus according to an embodiment. In FIG. 1, an image forming apparatus 100 is an electrophotographic copier. The image forming apparatus 100, which may also be a printer or a MFP (Multi-Functional Peripheral) in addition to a copier, is described hereinafter as a copier.

A printer section 10 is arranged in the center of the image forming apparatus (copier) 100. The printer section 10 comprises a freely rotatable photoconductive drum 11, which is an image carrier having an organic photoconductor (OPC) on the outer peripheral surface. When the photoconductive drum 11 endowed with a given potential is irradiated with light, the potential in the irradiated area is changed, and the change in the potential is kept for a given time as an electrostatic latent image.

A charger 12, an exposure unit 13, a developing device 14, a transfer roller 15, a drum cleaner 16 and a charge removing LED 17 are arranged around the photoconductive drum 11 along the rotation direction T of the photoconductive drum 11.

The charging charger 12 charges the surface of the photosensitive drum 11 to a given potential. The exposure unit 13 irradiates the photoconductive drum 11 with a laser beam LB to expose the photoconductive drum 11 to form an electrostatic latent image on the surface of the photoconductive drum 11. The emission intensity of the laser beam LB is changed according to the concentration of an image.

The developing device 14 in which a two-component developing agent including a carrier and a toner is accommodated feeds the developing agent to the surface of the photoconductive drum 11 to develop the electrostatic latent image on the photoconductive drum 11. The electrostatic latent image on the surface of the photoconductive drum 11 is visualized to form a toner image. The transfer roller 15 constitutes a transfer device for endowing a sheet S serving as a recording medium with a given potential to transfer the toner image on the photoconductive drum 11 onto the sheet S. The drum cleaner 16 removes and collects the residual toner adhered on the surface of the photoconductive drum 11. The charge removing LED 17 removes the residual charges on the photoconductive drum 11. Further, a fixer 40 is arranged at the downstream side of the transfer roller 15. The fixer 40 heats, presses and conveys the sheet S at a given temperature to fix the toner image on the sheet S. The fixer 40 will be described later in detail.

A developing agent cartridge 19 for accommodating a toner and a developing agent are arranged above the developing device 14 so that the toner and the developing agent are replenished from the cartridge 19 to the developing device 14 when the toner and the developing agent in the developing device 14 are consumed. The developing agent cartridge 19 which is replaceable is hereinafter referred to as a cartridge for short.

On the other hand, a scanner section 20 is arranged on the upper part of the image forming apparatus 100. The scanner section 20 comprises a light source 22 for irradiating an original placed on an original placing table 21; a reflecting mirror 23 for reflecting the light reflected from the original; and an imaging sensor 24 for receiving the light reflected from the reflecting mirror 23. Further, an original cover 25 is openably/closably arranged on the upper part of the original placing table 21. An operation panel 26 is arranged nearby the scanner section 20. The operation plane 26 includes a touch panel type display section 27 and operation keys 28.

A paper feed cassette 31 is arranged on the lower part of the image forming apparatus 100. A plurality of paper feed cassettes may be set, depending upon the sizes of sheets. The sheet S (recording medium) in the paper feed cassette 31 is guided to the transfer roller 15 via a pickup roller 32, an alignment roller 33 and a register roller 34. The pickup roller 32 picks up the sheet S in the paper feed cassette 31 one by one and conveys the sheet S picked up to the alignment roller 33. To align the toner image formed on the photoconductive drum 11 with the position of the sheet S, the alignment roller 33 rotates at a given time to convey the sheet S to a transfer position. The sheet S passing the transfer roller 15 is conveyed via the fixer 40 and discharged to a paper discharging tray 37 by a paper discharging roller 36.

In the case of simplex printing, a sheet S is conveyed along a conveyance path 38 starting from the register roller 34, sequentially passing through the transfer roller 15 and the fixer 40 and ending at the paper discharging roller 36. Further, in the case of duplex printing, a reverse conveyance path 39 is used. In the case of duplex printing, a sheet S is temporarily conveyed from the paper discharging roller 36 towards the paper discharging section 37 and then switched back to be conveyed along the conveyance path 39. A plurality of conveyance rollers are arranged on the reverse conveyance path 39 to reverse and guide the sheet S to the register roller 34.

To form an image, the original on the original placing table 21 is irradiated with the light from the light source 22, the light reflected from the original enters the imaging sensor 24 via the reflecting mirror 23, and then the image of the original is read. A laser beam LB is output from the exposure unit 13 according to the information read by the imaging sensor 24 or the image information provided from the outside, for example, from a PC (Personal Computer), to irradiate the surface of the photoconductive drum 11. The surface of the photoconductive drum 11 is negatively charged by the charging charger, and is irradiated with the laser beam LB from the exposure unit 13, and therefore the photoconductive drum 11 is exposed to form an electrostatic latent image on the surface of the photoconductive drum 11.

Toner is adsorbed on the electrostatic latent image formed on the photoconductive drum 11 by the developing device 14 to form a visible image (toner image). Then, if a sheet S picked up from the paper feed cassette 31 is conveyed, the toner image formed on the photoconductive drum 11 is transferred onto the sheet S by the transfer roller 15. The sheet S on which the toner image is transferred is conveyed to the fixer 40, and the fixer 40 heats, presses and fixes the image on the sheet S. The sheet S on which the image is fixed is discharged to the paper discharging tray 37 by the paper discharging roller 36.

Figure 2:
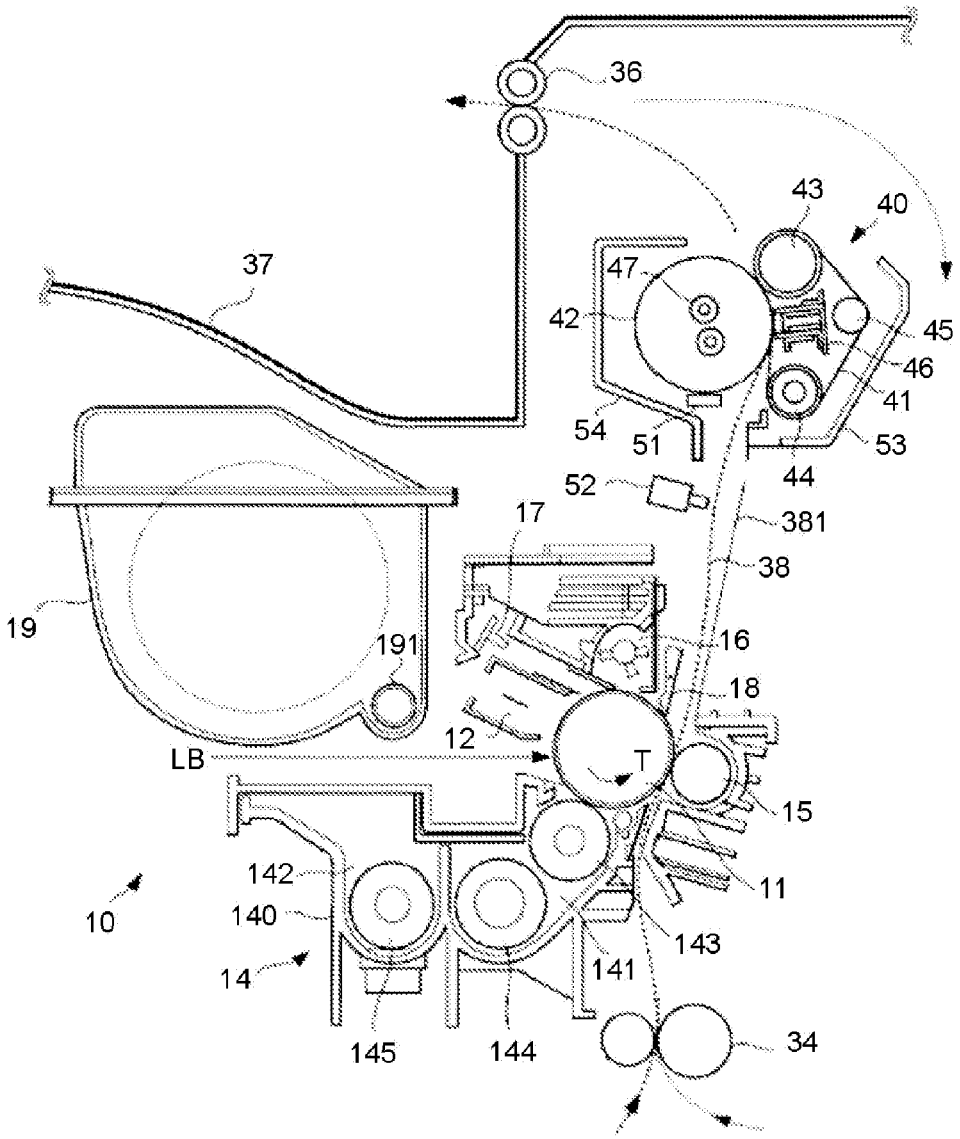
FIG. 2 is a diagram illustrating the detailed constitution of a printer section according to an embodiment.

FIG. 2 is a diagram illustrating the detailed constitution of the printer section 10 and a front view of the developing device 14 seen from a near side (front side). The dotted line 38 shown in FIG. 2 represents a conveyance path for a sheet S. As shown in FIG. 2, the cartridge 19 for supplying a toner and a developing agent to the developing device 14 is arranged above the developing device 14 so that the developing agent and the toner are supplied from the cartridge 19. The cartridge 19 is provided with a feed section 191 which is rotated by a drive device to supply the developing agent and the toner to the developing device 14.

The developing device 14 comprises a container 140 for accommodating a two-component developing agent (hereinafter referred to as a developing agent) including a carrier and a toner, the container 140 has, for example, two chambers 141 and 142. A developing roller 143 and a first mixer 144 are arranged in the chamber 141 of the container 140 opposite to the photoconductive drum 11. A second mixer 145 is arranged in the chamber 142 of the container 140.

The charging charger 12 for uniformly charging the photoconductive drum 11 according to the rotation of the photoconductive drum 11, the exposure unit 13 (shown in FIG. 1) for irradiating the charged photoconductive drum 11 with a laser beam LB corresponding to image information, the developing device 14, the transfer roller 15 constituting a transfer device, the peeling claw 18, the drum cleaner 16 and the charge removing LED 17 are arranged around the photoconductive drum 11.

A sheet S fed from the paper feed cassette 31 is conveyed in synchronization with the toner image on the photoconductive drum 11 by the register roller 34 at a transfer position formed by the photoconductive drum 11 and the transfer roller 15 of the printer section 10. The developing device 14 accommodates a two-component developing agent composed of a toner and a magnetic carrier, a development bias is applied to the developing roller 143 of the developing device 14 to forma toner image on the electrostatic latent image on the photoconductive drum 11.

Figure 3:
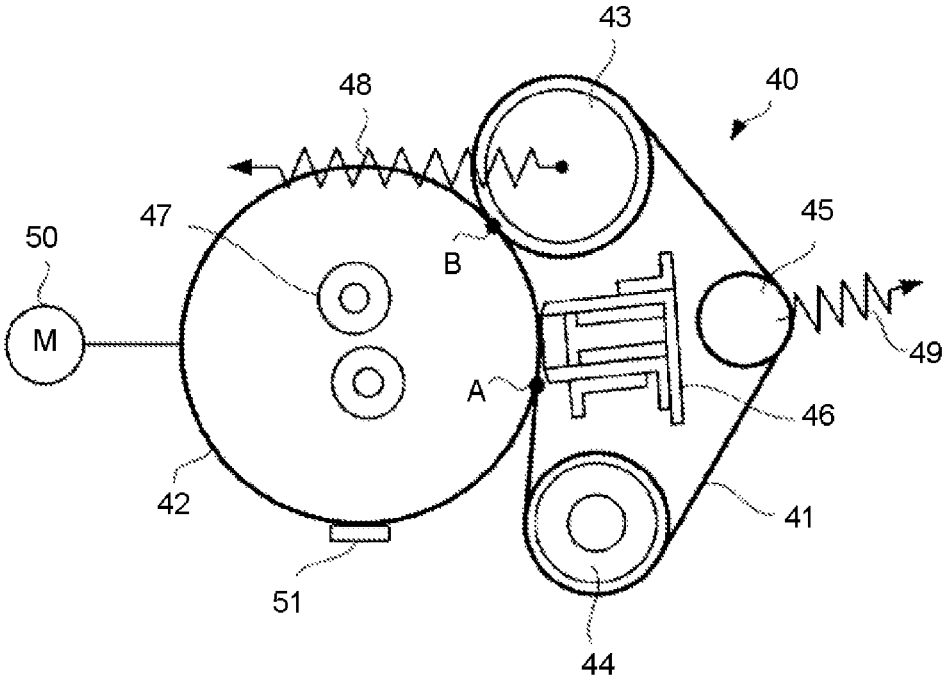
FIG. 3 is a diagram illustrating the amplified constitution of a fixer according to an embodiment.

Then, the fixer 40 is described below. FIG. 3 is a diagram illustrating the amplified constitution of the fixer 40. As shown in FIG. 2 and FIG. 3, the fixer 40 comprises a fixing belt 41, a heat roller 42, a press roller 43, an auxiliary roller 44 and a tension roller 45. The auxiliary roller 44 is arranged at the side from where a sheet S is conveyed into the image forming apparatus, the fixing belt 41 which is stretched by the press roller 43, the auxiliary roller 44 and the tension roller 45 is wound on a part of the heat roller 42.

Further, the fixer 40 comprises a pad member 46, a heating halogen lamp 47, a press spring 48 and a spring 49 for applying tension. The press roller 43 is pressed against the heat roller 42 across the fixing belt 41 under a given height applied by the press spring 48. The tension roller 45 applies a given tension to the fixing belt 41 via the spring 49. The part starting from the point A (hereinafter referred to a first nip point A) from where the fixing belt 41 contacts the heat roller 42 to the point B (hereinafter referred to as a second nip point B) where the press roller 43 presses the heat roller 42 is referred to as a fixing nip section.

The toner on a sheet S is fixed by heat and pressure when the sheet S passes through the fixing nip section. The heat roller 42 is driven by a DC brushless motor 50 fixed on the printer section 10 to rotate.

The fixing belt 41, the press roller 43, the auxiliary roller 44 and the tension roller 45 are driven through the rotation of the heat roller 42. Further, the fixing belt 41 is pressed against the heat roller 42 through the pad member 46. The heat roller 42 is formed by coating, for example, PTFE (Polytetrafluoroethylene) on the surface of a hollow cylinder made of metal.

A halogen lamp 47 is arranged inside the heat roller 42 to heat the heat roller 42 by emitting the heat from the inside of the heat roller 42. Further, a thermistor 51 is arranged to be contacted with the surface of the heat roller 42 to detect the temperature of the heat roller 42. The ON/OFF of the halogen lamp 47 is controlled by using the output of the thermistor 51 so as to keep the surface of the heat roller 42 at a given temperature.

Further, in FIG. 2, the register roller 34, the transfer roller 15, the heat roller 42 and the press roller 43 of the fixer 40 and the paper discharging roller 36 convey a sheet S to the printer section 10 and synchronously convey a sheet on which an image is formed by the printer section 10 to the paper discharging section 37. Further, the transfer roller 15, the register roller 34 and the paper discharging roller 36 are driven by motors (not shown), respectively, the rotation of those motors is controlled by a printer CPU 111.

Further, as shown in FIG. 2, a sensor 52 for detecting the position of a sheet S is arranged on the conveyance path 38 between the transfer roller 15 and the fixer 40. The sensor 52 detects the position of a sheet S in the direction orthogonal to the conveyance direction of the sheet S on the conveyance path 38. The sensor 52 detects the position of the image side (the side on which toner is adhered) of the sheet S and the bending amount of the sheet S. For example, the sensor 52 sends ultrasonic wave towards a sheet S and detects the ultrasonic wave reflected from the sheet S, thereby measuring the distance between the sheet S and the sensor 52. Then, if the distance between the sheet S and the sensor 52 is close to a preset distance, then it is determined that the bending amount of the sheet S exceeds a preset one and the sheet S is bent. Further, in FIG. 2, there is a conveyance guider 381 along the conveyance path 38, thus, the sheet S only bends towards the sensor 52.

Further, the fixer 40 includes an entrance guide 53 for guiding a sheet S to the nip between the heat roller 42 and the press roller 43, and a casing 54 for preventing a deformed sheet from entering a direction reverse to the rotation direction of the heat roller 42.

Figure 4:
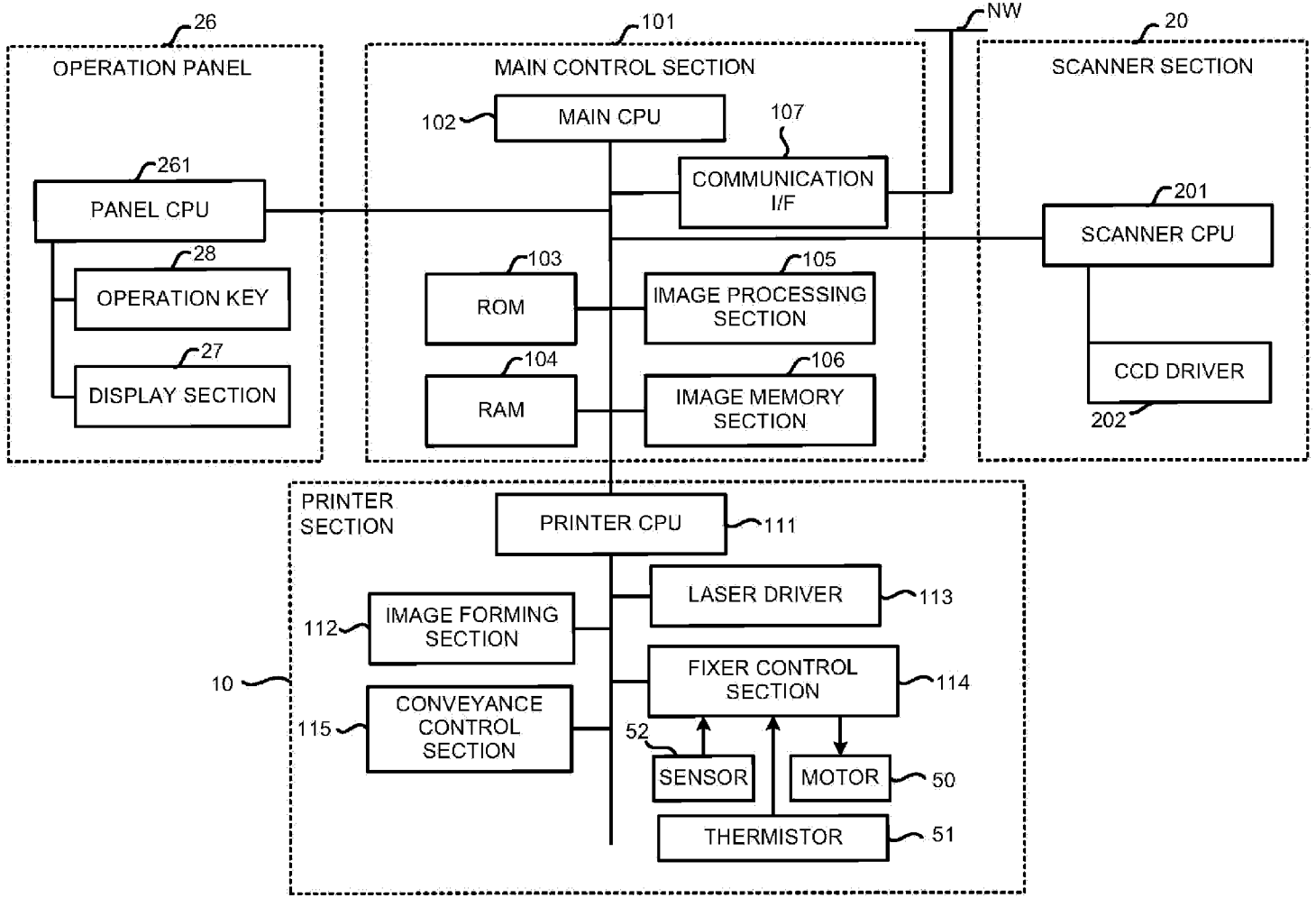
FIG. 4 is a block diagram illustrating the control system of the image forming apparatus according to an embodiment.

FIG. 4 is a block diagram illustrating the constitution of the control system of the image forming apparatus 100 according to an embodiment. In FIG. 4, the image forming apparatus 100 comprises a main control section 101, an operation panel 26, a scanner section 20 and a printer section 10. The control system of the image forming apparatus 100 comprises a main CPU 102 in the main control section 101, a panel CPU 261 of the operation panel 26, a scanner CPU 201 of the scanner section 20 and the printer CPU 111 of the printer section 10, which communicate with each other.

The main control section 101 comprises the main CPU 102, a ROM 103, a RAM 104, an image processing section 105, an image memory section 106 such as a HDD and a communication interface (I/F) 107 and the like. The main CPU 102 controls the whole operation of the image forming apparatus 100. Control programs are stored in the ROM 103. The data used by the CPU 10 to execute various processing is temporarily stored in the RAM 104.

The image processing section 105 processes the image data read by the scanner section 20 or the image data received from a PC and the like to carry out various image processing such as an image conversion processing of magnifying or reducing an image, and the like.

Further, the image memory section 106 compresses and stores the image data read by the scanner section 20 or the image data (document data or write image data) received from the PC. The image data stored in the image memory section 106 is input into the image processing section 105 to be subjected to various image processing and then printed on a sheet by the printer section 10.

The operation panel 26 comprises a panel CPU 261 connected with the main CPU 102, a display section 27 consisting of liquid crystal and various operation keys 28. The display section 27 having the functions of a touch panel inputs an instruction on paper size, print magnification, simplex printing or duplex printing, and the operation keys 28 include a numeric key for giving an instruction on printing number of copies, and the like.

The scanner section 20 comprises a CCD driver 202 which drives the image sensor to read the image of an original and converts the read image into image data.

The printer section 10 comprises the printer CPU 111, an image forming section 112, a laser driver 113 for driving the laser of the exposure unit 13, a fixer control section 114 for controlling the fixer 40 and a conveyance control section 115 for controlling the conveyance of a sheet S. The printer section 10 cooperates with the main control section 101 to carry out a print process.

The printer CPU 111 controls the image forming section 112 which controls the photoconductive drum 11, the charging charger 12, the developing device 14, the transfer roller 15 and the like to form an image.

The fixer control section 114 controls the rotation of the motor 50 for driving the heat roller 42. Further, the thermistor 51 and the sensor 52 are connected with the fixer control section 114, and the temperature of the halogen lamp 47 of the heat roller 42 is controlled according to the temperature detection result of the thermistor 51, and the bending amount of a sheet S is detected by the sensor 52 to control the rotation speed of the motor 50 (heat roller 42).

The conveyance control section 115 controls at least one of the transfer device and the fixer 40 so that a sheet S is conveyed between the transfer device (transfer roller 15) and the fixer 40 in a bent state in a case where the conveyance of the sheet S is controlled by a motor (not shown) for driving the transfer roller 15, the register roller 34 and the paper discharging roller 36 and the bending amount of the sheet S is reduced when the bending amount of the sheet S exceeds a preset one according to the detection result of the sensor 52.

Figure 5C:
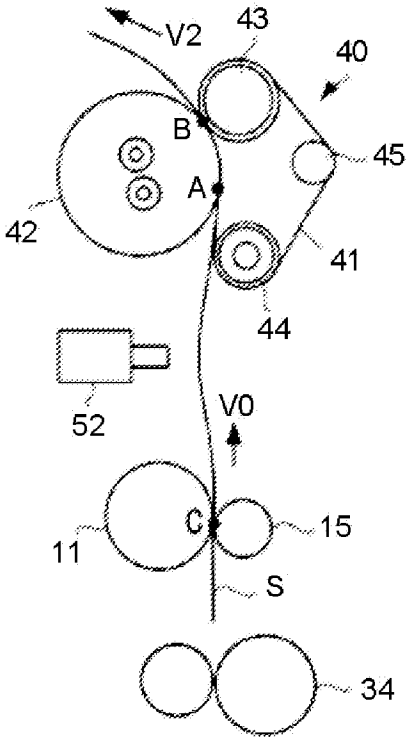
FIG. 5A-FIG. 5C are illustration diagrams showing a state in which a sheet is conveyed through a transfer roller and a fixer.
Figure 5B:
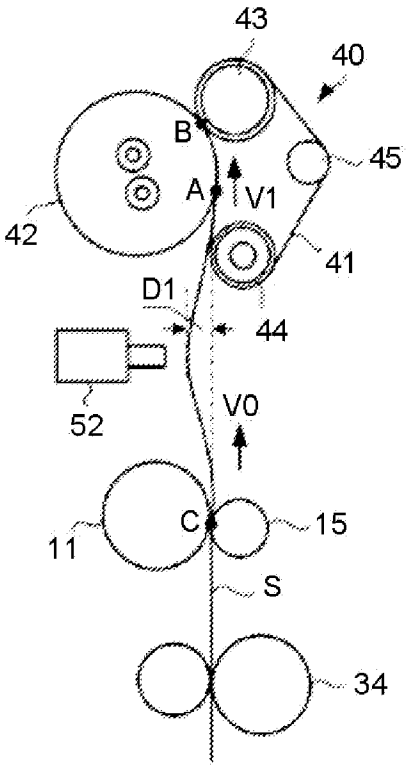
Figure 5A:
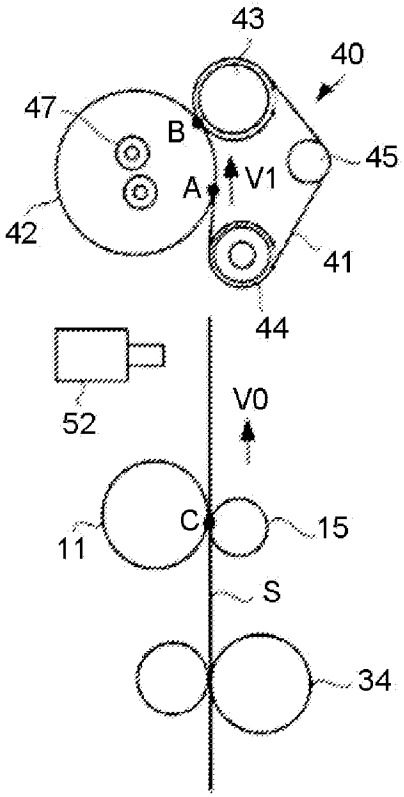

Next, the control over the conveyance speed of a sheet S and the rotation speed of the heat roller 42 of the fixer 40 is described with reference to FIG. 5A-5C. FIG. 5A-5C are illustration diagrams illustrating a state in which a sheet is conveyed through the transfer roller 15 and the fixer 40.

FIG. 5A represents a state in which the front end of a sheet S passes the transfer part C between the photoconductive drum 11 and the transfer roller 15 from the register roller 34 and is conveyed towards the first nip point A. In the state shown in FIG. 5A, the sheet S is conveyed at a conveyance speed V0. Further, through the rotation of the heat roller 42 of the fixer 40, the sheet S is conveyed through the fixer 40 at a lower conveyance speed V1 than V0 (V0>V1).

FIG. 5B shows a state in which the front end of a sheet S is conveyed from the first nip point A to the second nip point B. In the state shown in FIG. 5B, the front end part of the sheet S clamped by the fixing nip section is conveyed at the conveyance speed V1 at which the sheet S is conveyed through the fixer, and the part of the sheet S not clamped by the fixing nip section is conveyed at the conveyance speed V0.

The conveyance speed V1 is set to be a speed which is decelerated by 1.0%-10.0% with respect to the conveyance speed V0. Thus, the front end of the sheet S is conveyed at a lower speed that the rear end, and because of the speed difference, the sheet S between the first nip point A of the fixer 40 and the transfer part C between the photoconductive drum 11 and the transfer roller 15 bends. Further, when the front end of the sheet S reaches the second nip point B, a fluctuation in the conveyance speed of the sheet S occurs under the pressing force of the heat roller 42 and the press roller 43.

However, as the sheet S is in a bent state between the first nip point A of the fixer 40 and the transfer part C, the speed fluctuation occurred at the front end of the sheet S is not transferred to the transfer part C. Thus, the vibration caused by the speed fluctuation is prevented from being transferred to the transfer part C via the sheet S, which reduces the possibility of the occurrence of the deterioration in the quality of an image during a transfer process.

Further, the bending amount of the sheet S is changed according to the basis weight of the sheet or a different environment. Thus, a sensor 52 for detecting the bending amount of a sheet S is arranged to prevent that the speed fluctuation of the sheet S is propagated to the transfer part C when the bending amount of the sheet S indeed exceeds a preset one even if in a case of a different bending amount. The conveyance speed of the sheet S can be changed when the sensor 52 detects that the bending amount (D1) of the sheet S reaches a given amount.

FIG. 5C shows a state in which the speed of a sheet can be changed based on the bending amount detected by the sensor 52. In the state shown in FIG. 5C, the conveyance speed through the fixer 40 is changed to V2 (V2>V0). As the front end part than the part of the sheet S clamped by the fixing nip section is conveyed at the conveyance speed V2 of the fixer 40, and the part of the sheet S not clamped by the fixing nip section is conveyed at the conveyance speed V0.

In the state shown in FIG. 5C, as the conveyance speed V2 is higher than the conveyance speed V0, the front end of the sheet S is conveyed faster than the rear end thereof, and because of the speed difference, the sheet S between the first nip point A of the fixer 40 and the transfer part C is stretched under a tension and therefore the bending becomes small. When the bending becomes small, an unfixed image is not contacted with the peeling claw 18 or the casing 54 of the printer section 10, thus preventing the deterioration of the quality of the image. On the other hand, when the rear end of the sheet S passes through the transfer part C under a strong tension, the sheet flutters, which may lead to the deterioration of the quality of an image, thus, it is not preferable to set a large speed difference.

Figure 6:
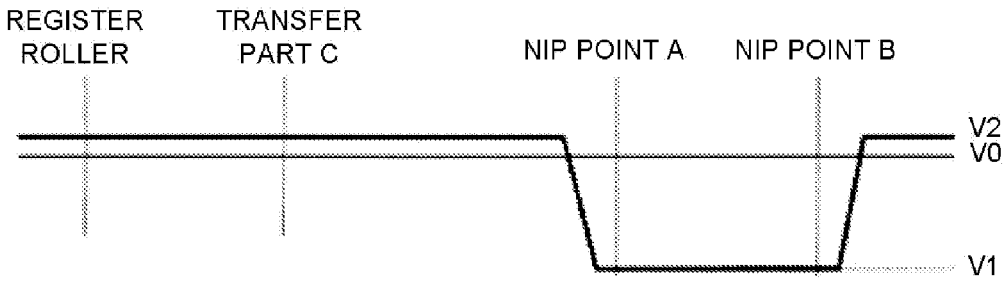
FIG. 6 is an illustration diagram showing an example of the setting on the conveyance speed and the fixing speed of a sheet.

FIG. 6 is an illustration diagram illustrating the conveyance speed of a sheet S and the rotation speed of the heat roller 42 in each sheet conveyance state. In FIG. 6, the speed at which the sheet S is conveyed through the fixer 40 according to the rotation of the heat roller 42 of the fixer 40 is referred to as a fixing speed, and the speed at which the sheet S is conveyed according to the rotation of the photoconductive drum 11 or the register roller 34 is referred to as a processing speed.

In FIG. 6, if the processing speed is set to be V0 and the fixing speed at which the front end of the sheet S passes through at least one part of the fixing nip section is set to be V1, then it is set that V1 is lower than V0. Further, if the fixing speed at which the front end of the sheet S passes through at least one part of the fixing nip section is set to be V1 and the speed at which the sheet S is conveyed through the fixer 40 in a conveyance area after the front end of the sheet S passes through the second nip point B, then it is set that V1 is lower than V2.

The processing speed is V0, and the conveyance speed of the sheet S before the front end of the sheet S enters the fixing nip section is V0 (FIG. 5A). The front end of the sheet S decelerates just before entering the fixing nip section, and the speed of the front end of the sheet S is reduced to V1 when the front end of the sheet s enters the fixing nip section. That is, the fixing speed becomes V1 when the front end of the sheet S is clamped by the heat roller 42 and the press roller 43 so that a speed difference is occurred between the fixing speed V1 and the processing speed V0 to bend the sheet S (FIG. 5B). When the bending amount of the sheet S increases, the sensor 52 detects the bending amount to control the bending amount to be lower than a given amount, and the fixing speed is increased to V2 (FIG. 5C). In this way, the bending amount is reduced.

Figure 7:
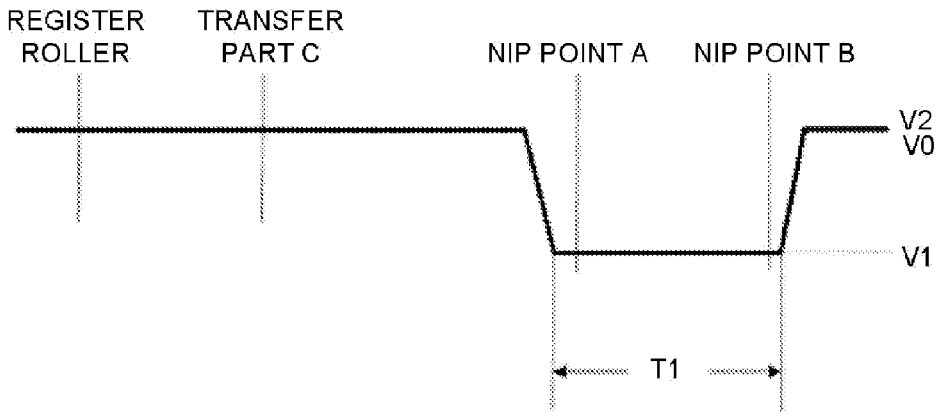
FIG. 7 is an illustration diagram showing another example of the setting on the conveyance speed and the fixing speed of a sheet.

FIG. 7 is an illustration diagram showing another example of the setting of the processing speed and the fixing speed of a sheet in each conveyance state of the sheet S.

That is, in the state shown in FIG. 5A, it is set that the processing speed V0 is equal to the fixing speed V2, as shown in FIG. 7. Further, in the state shown in FIG. 5B, the fixing speed is reduced just before the front end of the sheet S enters the fixing nip section, and the fixing speed is reduced to V1 when the front end enters the fixing nip section. The time T1 the fixing speed V1 is kept can be changed according to the bending amount of the sheet S. That is, the larger the bending amount of the sheet S is, the shorter the fixing speed V1 is kept, and the smaller the bending amount of the sheet S is, the longer the fixing speed V1 is kept.

Further, in the state shown in FIG. 5C, the fixing speed V2 is equal to the processing speed V0.

In the example shown in FIG. 7, as the fixing speed V2 is equal to the processing speed V0, no speed difference is generated between the front end and the rear end of the sheet S, the sheet S is conveyed in a certain bent state between the first nip point A of the fixer 40 and the transfer part C between the photoconductive drum 11 and the transfer roller 15. Thus, an unfixed image is not contacted with the peeling claw 18 or the casing 54 of the printer section 10, which prevents the deterioration of the quality of the image.

The drive source of the heat roller 42 of the fixer 40 may be an outer rotor type DC brushless motor 50. The timing at which the fixing speed of the fixer 40 is switched from V1 to V2 or from V2 to V1 can be determined according to the detection timing of the sensor 52.

Further, the rotation speed of the DC brushless motor 50 can be changed by switching the frequency of a clock signal according to the detection timing of the sensor 52. The rotation speed of the DC brushless motor 50 is not changed instantly even if the clock signal which determines the rotation speed of the DC brushless motor 50 is switched. For example, when the rotation speed is changed by 3-5%, the rotation speed of the DC brushless motor 50 is gradually changed to a given speed within 30-50 msec after the clock signal is changed. When the processing conveyance speed V0 described herein is set to be, for example, 140 mm/sec, the distance conveyed within 30-50 msec is about 4-7 mm, and therefore, the distance is taken into consideration in the determination of a bending amount.

That is, after the position of the sheet is detected by the sensor 52, the increase of the bending amount is taken into consideration to determine a bending amount to be a value at which an unfixed image is not contacted with the peeling claw 18 or the casing 54 of the printer section 10.

Further, if the speed difference between the processing speed and the fixing speed is large, then the DC brushless motor 50 may easily occur a speed undershoot or a speed overshoot due to the inertial of the rotor. Thus, to prevent the speed undershoot or speed overshoot, it is preferred to switch the frequency of the clock signal several times in stages. Further, the drive source of the heat roller 42 may also be a pulse motor. A pulse motor can switch a speed more accurately than a DC brushless motor, however, heat emission and noise should be taken into consideration in the design of the pulse motor.

Further, it is described above that the processing speed V0 is set fixedly and a sheet S is conveyed through the fixer 40 at a lower conveyance speed V1 than V0 so that the sheet S is bent, however, the conveyance speed V1 at which the sheet S is conveyed through the fixer 40 may be fixed and the processing speed V0 may be controlled to be faster than the conveyance speed V1 to bend the sheet S, moreover, the bending amount of the sheet may be controlled by varying the processing speed V0, that is, the sheet S can be bent as long as at least one of the processing speed V0 and the conveyance speed V1 is controlled.

As stated above, in the present embodiment, the deterioration of the quality of the image on a sheet caused by the impact generated when the sheet enters the second nip point B between the heat roller 42 and the press roller 43 can be prevented. Further, the bending of the sheet between the fixer 40 and the transfer part C is not large, thus reducing the size of the image forming apparatus.

Embodiment 2

Embodiment 2 is described below in which a contact type sensor 55 is used to replace the ultrasonic sensor 52 used in embodiment 1.

Figure 8:
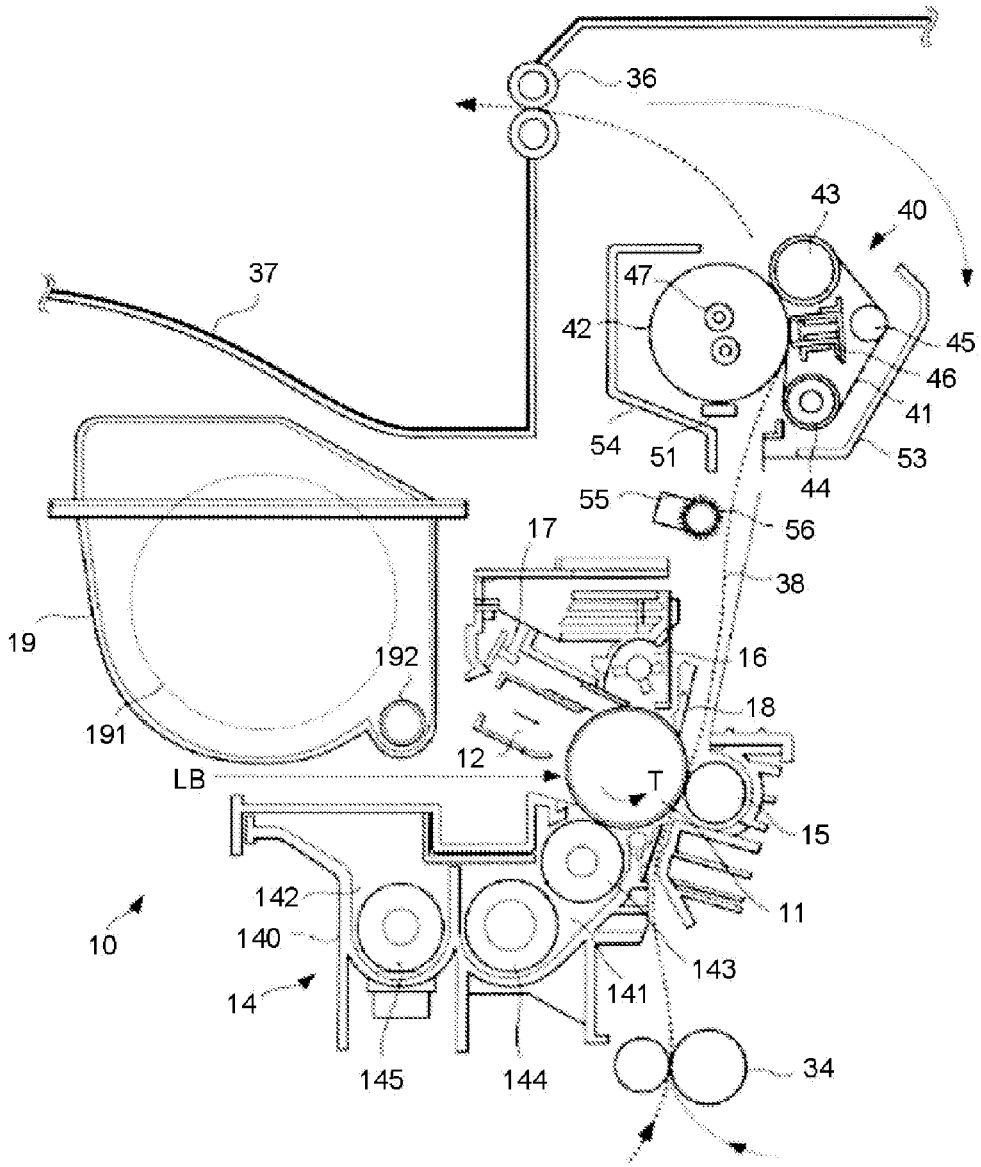
FIG. 8 is a diagram illustrating the constitution of an image forming apparatus according to embodiment 2.

FIG. 8 is a diagram illustrating the constitution of an image forming apparatus according to embodiment 2. In FIG. 8, a sensor 55 having a star wheel 56 is used to detect the bending of a sheet S. The other components excluding the sensor 55 are the same as those shown in FIG. 2.

The sensor 55 is arranged in such a manner that the star wheel 56 at the front end of the sensor 55 is located at a given distance apart from the conveyance path 38 of a sheet S. The star wheel 56 made of metal is rotated under the conveyance force of the sheet S when the sheet S is bent to contact with the star wheel 56 and is contacted with the image (toner) formed on the sheet S to detect the sheet S.

In the shape of a star, the star wheel 56 is contacted with the sheet S in a small area. The sensor 55 is switched on when the image (toner) formed on the bent sheet S is contacted with the star wheel 56 to transmit a signal to the fixer control section 114. The control over the conveyance of the sheet S after it is detected that the sheet is bent is the same as that described in embodiment 1.

The image forming apparatus according to the embodiments described above is capable of preventing the deterioration of the quality of an image caused by the impact generated when a sheet enters the part between a press roller and a heat roller, meanwhile, the image forming apparatus the size of which is reduced as the bending amount of the sheet between a fixer and a transfer part is not large.

The present invention is not limited to the aforementioned embodiments and can have various applications. For example, the image forming apparatus may be provided with a plurality of color developing units, like a quadruple tandem machine. Further, the exposure unit 13 having a laser light source may be replaced with a scanning head having a LED element.

Further, the fixer 40 having a fixing belt 41 is used in the embodiments described above, however, the preset invention is not limited to this, a fixer capable of forming a nip with a heat roller and a press roller may be used to achieve the same effect.

Further, the printer section 10 carries out the control over the fixer 40 using the fixer control section 114 and the conveyance control section 115 carries out the control over a sheet are exemplified above, however, the fixer 40 and the conveyance of a sheet may be controlled by a single control section (e.g. the main CPU 102 or the printer CPU 111).

While certain embodiments have been described, these embodiments have been presented by way of example only, and are not intended to limit the scope of the invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a transfer device configured to transfer an image onto a conveyed recording medium;

a fixer configured to heat, press and convey the recording medium to fix the transferred image on the recording medium;

a sensor configured to detect the bending amount of the recording medium between the transfer device and the fixer, the sensor is non-contacted with the recording medium, and arranged towards a side of the recording medium on which the transferred image is fixed; and a control section configured to control at least one of the transfer device and the fixer so that the recording medium between the transfer device and the fixer is conveyed in a bent state and the bending amount of the recording medium is reduced if the bending amount of the recording medium exceeds a preset one according to the detection result of the sensor.

2. The apparatus according to claim 1, wherein the control section controls the speed at which the recording medium is conveyed through the fixer to be lower than the speed at which the recording medium is conveyed from the transfer device to the fixer so that the recording medium is conveyed in a bent state.

3. The apparatus according to claim 1, wherein the control section controls the speed at which the recording medium is conveyed through the fixer to be higher than the speed at which the recording medium is conveyed from the transfer device to the fixer when the bending amount of the recording medium is larger than a preset one according to the detection result of the sensor.

4. The apparatus according to claim 1, wherein the transfer device comprises a transfer roller for transferring the image formed on a photoconductive drum onto the recording medium;

the control section sets V0 to be higher than V1 to bend the recording medium when the processing speed at which the recording medium is conveyed is set to be V0 according to the rotation of the photoconductive drum and the fixing speed at which the recording medium is passed through the nip part of the fixer is set to be V1.

5. The apparatus according to claim 4, wherein the control section controls the fixing speed of the fixer to be V2 (V2>V0) if the bending amount of the recording medium is larger than a preset one according to the detection result of the sensor.

6. The apparatus according to claim 4, wherein the control section sets the fixing speed of the fixer to be V1 and the bending amount of the recording medium during a period of the fixing speed V1 changeable if the bending amount of the recording medium is larger than a preset one according to the detection result of the sensor.

7. The apparatus according to claim 6, wherein the control section carries out a control so that the larger the bending amount of the recording medium is, the shorter the fixing speed V1 is kept, and the lower the bending amount of the sheet S is, the longer the fixing speed V1 is kept.

8. The apparatus according to claim 1, wherein the fixer comprises a heat roller, a press roller arranged opposite to the heat roller and rotated along with the heat roller, and a fixing belt stretching among a plurality of rollers including the press roller and an auxiliary roller arranged at the side from where the recording medium is conveyed into the apparatus and connected with the periphery of the heat roller; and the recording medium is conveyed while being clamped by a fixing nip section between the heat roller and the fixing belt.

9. The apparatus according to claim 1, wherein the fixer comprises a motor for rotating the heat roller; and the motor controlled by the control section is a DC brushless motor the rotation speed of which is not changed instantly even if a clock signal for determining the rotation speed is switched.

10. The apparatus according to claim 1, wherein the sensor detects the position of the recording medium in the direction orthogonal to the conveyance direction of the recording medium.

11. The apparatus according to claim 1, wherein the sensor is an ultrasonic sensor arranged at a position where the sensor is not connected with the recording medium.

12. A method for controlling the conveyance speed of a recording medium in an image forming apparatus, comprising:

transferring an image onto a conveyed recording medium using a transfer device;

conveying the recording medium in a bent state from the transfer device to a fixer when the transferred image is fixed on the recording medium by the fixer which heats, presses and conveys the recording medium;

detecting the bending amount of the recording medium that non-contacted with the recording medium using a sensor arranged towards a side of the recording medium on which the transferred image is fixed; and controlling at least one of the transfer device and the fixer so that the bending amount of the recording medium is reduced if the bending amount of the recording medium is above a preset one according to the detection result of the sensor.

13. The method according to claim 12, wherein the speed at which the recording medium is conveyed through the fixer is lower than that at which the recording medium is conveyed from the transfer device to the fixer so that the recording medium is conveyed in a bent state.

14. The method according to claim 12, wherein a control is carried out so that the speed at which the recording medium is conveyed through the fixer is higher than the speed at which the recording medium is conveyed from the transfer device to the fixer when the bending amount of the recording medium is larger than a preset one according to the detection result of the sensor.

15. The method according to claim 12, wherein the transfer device comprises a transfer roller for transferring the image formed on a photoconductive drum onto the recording medium; and when the recording medium is conveyed at a processing speed V0 along with the rotation of the photoconductive drum and the front end of the recording medium is conveyed through the nip part of the fixer at a fixing speed V1, V0 is set to be higher than V1 to bend the recording medium.

16. The method according to claim 15, wherein the fixing speed of the fixer is controlled to be V2 (V2>V0) if the bending amount of the recording medium is larger than a preset one according to the detection result of the sensor.

17. The method according to claim 15, wherein the fixing speed of the fixer is set to be V1 when the bending amount of the recording medium is larger than a preset one according to the detection result of the sensor, and the bending amount of the recording medium during a period of the fixing speed V1 is set to be changeable.

18. The method according to claim 17, wherein the larger the bending amount of the recording medium is, the shorter the fixing speed V1 is kept, and the lower the bending amount of the sheet S is, the longer the fixing speed V1 is kept.

19. The method according to claim 12, wherein the sensor detects the position of the recording medium in the direction orthogonal to the conveyance direction of the recording medium and the bending amount of the recording medium.

* * * * *